US010254034B2

(12) United States Patent
Laible

(10) Patent No.: US 10,254,034 B2
(45) Date of Patent: Apr. 9, 2019

(54) DOMESTIC REFRIGERATION APPLIANCE COMPRISING AN ICE MAKER

(71) Applicant: BSH HAUSGERAETE GMBH, Munich (DE)

(72) Inventor: Karl-Friedrich Laible, Langenau (DE)

(73) Assignee: BSH Hausgeraete GmbH, Munich (DE)

( * ) Notice: Subject to any disclaimer, the term of this patent is extended or adjusted under 35 U.S.C. 154(b) by 4 days.

(21) Appl. No.: 15/519,895

(22) PCT Filed: Oct. 15, 2015

(86) PCT No.: PCT/EP2015/073871

§ 371 (c)(1),
(2) Date: Apr. 18, 2017

(87) PCT Pub. No.: WO2016/062608

PCT Pub. Date: Apr. 28, 2016

(65) Prior Publication Data

US 2017/0241692 A1 Aug. 24, 2017

(30) Foreign Application Priority Data

Oct. 21, 2014 (DE) ..... 10 2014 221 318

(51) Int. Cl.

| | |
|---|---|
| ***F25C 5/00*** | (2018.01) |
| ***F25C 5/20*** | (2018.01) |
| ***F25C 1/04*** | (2018.01) |
| ***F25C 5/18*** | (2018.01) |

(52) U.S. Cl.

CPC ..... *F25C 5/22* (2018.01); *F25C 1/04* (2013.01); *F25C 5/18* (2013.01); *F25C 2600/00* (2013.01); *F25C 2600/04* (2013.01); *F25C 2700/00* (2013.01); *F25C 2700/02* (2013.01)

(58) Field of Classification Search

CPC ..... F25C 5/005; F25C 5/18; F25C 2600/04; F25C 2700/00; F25C 2700/02

See application file for complete search history.

(56) References Cited

U.S. PATENT DOCUMENTS

| | | | | |
|---|---|---|---|---|
| 2005/0178135 | A1* | 8/2005 | Schanin | F25D 29/00 62/228.1 |
| 2007/0157645 | A1 | 7/2007 | Anell et al. | |
| 2012/0000216 | A1* | 1/2012 | Kim | F25C 1/00 62/66 |
| 2012/0000226 | A1 | 1/2012 | Yamaguchi et al. | |
| 2015/0355657 | A1* | 12/2015 | Yamato | F25D 29/00 700/297 |

* cited by examiner

*Primary Examiner* — Marc E Norman

(74) *Attorney, Agent, or Firm* — Laurence A. Greenberg; Werner H. Stemer; Ralph E. Locher

(57) ABSTRACT

A domestic refrigeration appliance includes a refrigerator compartment set to a first target temperature by a regulation or control unit, an ice maker compartment being separated from the refrigerator compartment by an inner insulation layer and set to a second target temperature by the regulation or control unit and an ice maker in the ice maker compartment. The regulation or control unit can switch between a normal ice making mode and a reduced-power ice making mode in which the target temperature in the ice maker compartment lies between the target temperature in the refrigerator compartment and the target temperature in the ice maker compartment in the normal ice making mode.

5 Claims, 1 Drawing Sheet

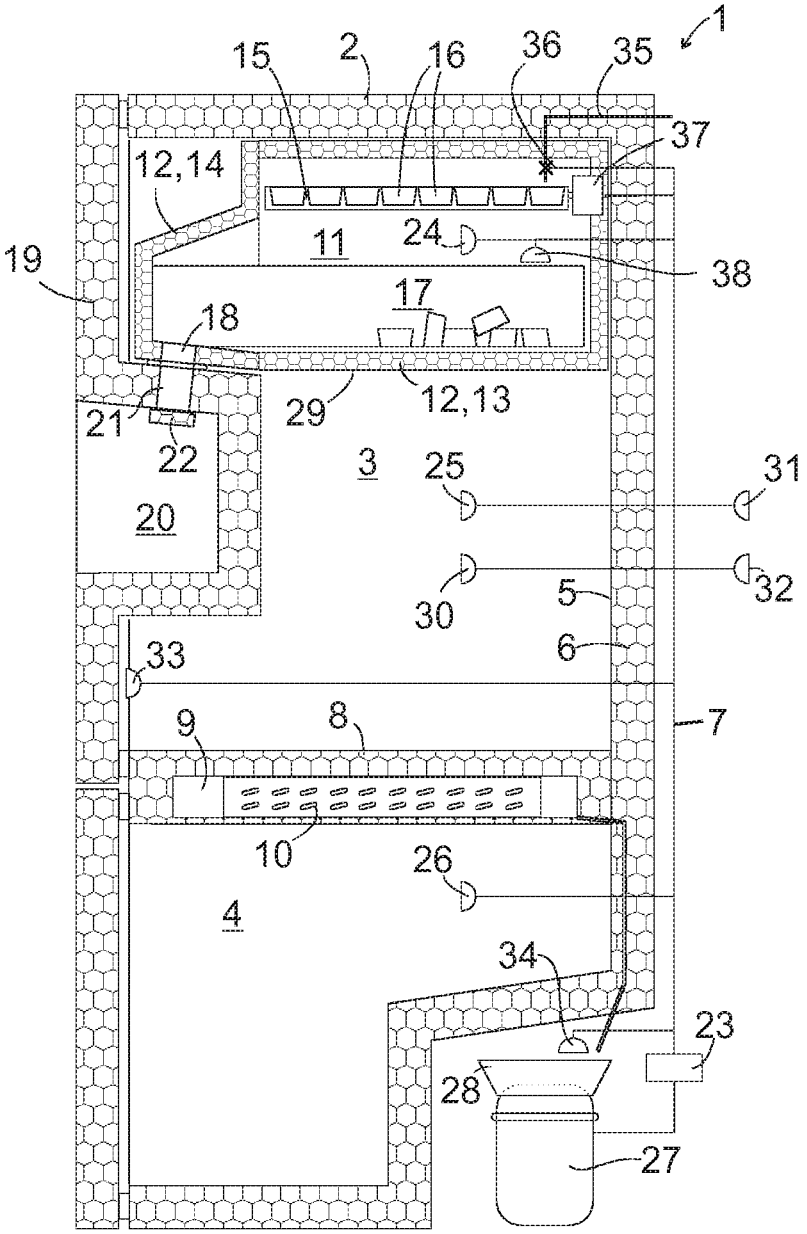
1
2
15
16
36
35
37
12,14
11
24
38
19
17
18
29
12,13
21
22
3
25
31
20
30
32
5
6
33
7
9
8
10
26
4
34
23
28
27

DOMESTIC REFRIGERATION APPLIANCE COMPRISING AN ICE MAKER

BACKGROUND OF THE INVENTION

Field of the Invention

The present invention relates to a domestic refrigeration appliance with an ice maker.

Refrigerator-freezer combinations in particular are increasingly frequently being equipped with an ice maker compartment separate from the refrigerator compartment. A compartment of this kind can be provided in the body or on the door of the refrigeration appliance. The ice maker compartment reduces the usable volume of the refrigerator compartment, as space is required for both the ice maker itself, to accommodate finished ice, and also for an inner insulation layer between the refrigerator compartment and the ice maker compartment.

If the refrigerator compartment and ice maker compartment are poorly insulated relative to one another, this results in a greater heat dissipation from the refrigerator compartment to the ice maker compartment. The total cooling output requirement of the refrigeration appliance changes marginally at best as a result; in a first approximation an increased cooling requirement of the ice maker compartment is compensated by a correspondingly decreased cooling requirement of the refrigerator compartment. In this respect, it appears to stand to reason to reduce the space requirement of the ice maker by reducing the thickness of the inner insulation layer. If this is made too thin, however, then this causes the problem of the surface of the inner insulation layer facing the refrigerator compartment potentially cooling down to below the dew point, so that humidity condenses out from the refrigerator compartment onto the surface of the insulation layer. A condensation of this kind must be avoided, however, as otherwise there is the danger of condensed water dripping from the surface of the insulation layer soaking goods stored in the refrigerator compartment.

This tendency toward condensation becomes higher as a result of warmer surroundings, in which the refrigeration appliance is placed, and as a result of higher humidity in the surroundings. A refrigeration appliance, which is configured for use in humid, warm climates, therefore requires a stronger inner insulation layer which only takes up unnecessary space when said refrigeration appliance is placed in cool, dry surroundings. It would indeed be conceivable to equip refrigeration appliances of this kind with differently strong inner insulation layers, depending on the intended operational surroundings, but this results in a high expenditure in both the production of the appliance and also later on during the outbound logistics.

SUMMARY OF THE INVENTION

The object of the present invention is therefore to specify a domestic refrigeration appliance with an ice maker, in which a condensation on the inner insulation layer during operation in humid and warm surroundings can be avoided, even with a minimal thickness of the inner insulation layer.

The object is achieved, in a domestic refrigeration appliance with a refrigerator compartment, which is regulated by a regulation unit to a first target temperature, and an ice maker compartment, which is separated from the refrigerator compartment by an inner insulation layer and regulated by the regulation unit to a second target temperature and contains an ice maker, by the regulation unit being able to be switched between a normal ice making mode and a reduced-power ice making mode, by the target temperature of the ice maker compartment being between the target temperature of the refrigerator compartment and the target temperature of the ice maker compartment in the normal ice making mode.

By scaling up the target temperature of the ice maker compartment in the reduced-power ice making mode, the temperature gradient in the inner insulation layer is reduced, so that the surface of the inner insulation layer facing the refrigerator compartment can achieve a temperature above the dew point and consequently no more precipitation of condensation takes place on the inner insulation layer.

The inner insulation layer preferably comprises a movable closure, which in a locked position blocks a passage between refrigerator compartment and ice maker compartment.

The low thickness of the inner insulation layer can make it difficult to produce the layer in the per se usual manner for an outer insulation layer by foaming onto a hollow body. Therefore, the inner insulation layer is preferably produced independently of the outer insulation layer, which can be obtained in the manner which is customary according to the state of the art by foaming onto a hollow body, and is separated from the outer insulation layer by an inner container forming a wall of said hollow body.

The regulation unit can be configured to switch from the normal ice making mode into the reduced-power ice making mode, if at least one of the following conditions is fulfilled:

a) The temperature in the surroundings of the domestic appliance is above a predefined threshold value. The amount of water which the ambient air can take in increases markedly with the temperature, so that at a higher ambient temperature the probability is high that, when the refrigeration appliance is opened, the humidity in the refrigerator compartment reaches such an amount that it results in the formation of condensation on the insulation layer.

b) The humidity in the surroundings of the domestic refrigeration appliance is above a predefined threshold value. Of course, the tendency toward the formation of condensation also increases with increasing relative humidity of the ambient air. Threshold values of the humidity and the temperature can be expediently saved in the form of a characteristic curve, which specifies the threshold value of the humidity as a function of the temperature or specifies the threshold value of the temperature as a function of the humidity.

c) The temperature in the refrigerator compartment is above a predefined threshold value. It can be that a threshold value of this kind—which should expediently be higher than the target temperature of the refrigerator compartment—may be exceeded in particular if a large amount of ambient air reaches the refrigerator compartment and accordingly the amount of water, which is stored in the air of the refrigerator compartment and can condense there, is large.

d) The humidity in the refrigerator compartment is above a predefined threshold value. This may also take the form of a characteristic curve, which links temperature and humidity of the refrigerator compartment to one another.

e) The frequency of door openings of the refrigerator compartment is above a predefined threshold value. This situation is particularly simple to record, as no temperature or moisture sensor is required, but rather a simple switch actuated by the door is sufficient, which is in any case generally already present in order to switch an interior light of the refrigerator compartment.

f) The water level in an evaporation pan is above a predefined threshold value. As a rule, domestic refrigeration appliances have an evaporation pan of this kind, in order to evaporate condensed water which collects on an evaporator of the refrigeration appliance. If a large amount of condensed water falls on the evaporator, there is a high tendency for the inner insulation layer to dew, so that in this case too it is sensible to switch into the reduced-power ice making mode. Means for recording a high water level in the evaporation pan are provided in some known refrigeration appliances, in order to prevent the evaporation pan from overflowing at a critically high water level by additional heating. Said means can therefore also be used in the context of the present invention without additional expenditure, in order to switch the regulation unit.

The threshold value, regardless of the temperature, the humidity, the frequency of door openings or the water level, is expediently predefined as a function of the first target temperature, as the probability of the surface temperature of the inner insulation layer exceeding the dew point is greater when the temperature difference between refrigerator compartment and ice maker compartment is larger.

It can be assumed that a user's need to produce ice quickly is low, if a large quantity of ice is already stored in a storage container. Therefore, a sensor for recording the fill level of the storage container expediently may be provided and the regulation unit may be configured, when a predefined fill level of the storage container is exceeded, to only authorize the reduced-power ice making mode.

The normal ice making mode should then be blocked at the latest when the storage container is too full to receive one more batch of ice from the at least one mold container. As, in this case, the mold container cannot be emptied when the ice therein is ready, there is no requirement to completely prepare the ice quickly; in this case energy can be saved by the increased target temperature of the ice maker compartment during the reduced-power mode.

BRIEF DESCRIPTION OF THE SEVERAL VIEWS OF THE DRAWING

Further features and advantages of the invention will emerge from the description of exemplary embodiments provided below, with reference to the attached FIGURE.

The FIGURE shows a schematic cross-section through a refrigeration appliance according to the invention.

DESCRIPTION OF THE INVENTION

FIG. 1 shows a vertical cross-section through a domestic refrigeration appliance 1 in accordance with the present invention. Shown here is a combined appliance with a refrigerator compartment 3 in the upper section of a body 2 and a freezer compartment 4 in the lower section. In a known manner, the two compartments 3, 4 are surrounded by a common deep-drawn inner container 5 made of a flat plastic material, and an intermediate space between the inner container 5 and an outer membrane 7 of the body 2 is filled with an outer insulation layer 6 made of foam.

Recessed into a horizontal dividing wall 8 inserted between the two compartments 3, 4 is a chamber 9, in which an evaporator 10 is accommodated. Channels (not shown) in the walls of the body 2 connect the chamber 9 to the compartments 3, 4 and a compartment 11 in the manner which is customary according to the state of the art.

The compartment 11 is an ice maker compartment, which is sectioned off in an upper region of the refrigerator compartment 3 by an inner insulation layer 12. The ice maker compartment 11 only fills up a portion of the width of the upper region of the body 2. Here, the inner insulation layer 12 is formed on the one hand by a rectangular box 13 open at its front side and on the other hand by a cover 14 closing off the open front side of the box 13.

In an upper region of the ice maker compartment 11, a tray 15 is attached with a plurality of mold containers 16 for molding one ice cube in each case. The tray 15 can be filled via a water line 35. The dosage of the water into the mold container 16 is effected by a valve 36 on the water line being held open during a predefined period of time. A motor 37 serves to pivot and warp the tray 15 once the ice cubes have been prepared. The ice cubes, which have been loosened from the mold containers 16 by the warping of the tray, fall into a storage container 17 arranged below the tray 15 and connected to the cover 14.

The storage container 17 extends up to a protrusion of the cover 14 which projects forward. On the underside of the protrusion a passage 18 is formed which, when the door 19 of the refrigerator compartment 3 is closed, is aligned with a passage 21 opening into a dispenser alcove 20 of the door 19. A flap 22 is mounted to the lower end of the passage 21 in a pivotable manner, which flap 22 prevents warm air from entering from the dispenser alcove 20 to the ice maker compartment 11 via the passages 18, 21 in the closed position shown.

An electronic regulation unit 23 is connected to temperature sensors 24, 25, 26 in ice maker compartment 11, refrigerator compartment 3 and freezer compartment 4, respectively, in order to compare the temperatures recorded by said sensors 24, 25, 26 in the compartments with target temperatures predefined for said compartments and to switch on a compressor 27 when the target temperature in one of the compartments 3, 4, 11 is exceeded by more than a permissible degree. The regulation unit 23 furthermore actuates flaps (not shown) in the channels of the body 2, in order to feed cold air generated by the operation of the compressor 27 in the evaporator 10 to the compartment 3, 4 or 11 needing to be cooled in each case.

Frost which precipitates on the evaporator 10 during operation is thawed from time to time and fed to an evaporation pan 28 heated by the waste heat of the compressor 27.

The target temperatures of the refrigerator compartment 3 and the freezer compartment 4 can be set individually at a user interface. This is not provided for the target temperature of the ice maker compartment 11 here; as explained below, this can be changed as a function of external conditions.

If the ice maker is switched off, the target temperature of the ice maker compartment 11 is set to be at least as high as that of the refrigerator compartment 3, so that no cooling demand can arise in the ice maker compartment 11, or the temperature of the ice maker compartment 11 recorded by the sensor 24 is simply not evaluated by the regulation unit 23.

If the ice maker is switched on, the regulation unit 23 assumes one of two operating states, either a normal ice making mode or a reduced-power ice making mode, which differ in terms of the target temperatures of the ice maker compartment 11.

The target temperature of the normal ice making mode lies significantly below 0° C., in order to ensure a rapid freezing of water in the mold containers 16. Said target temperature may have a fixed value, for example −18° C.; it may, however, also be specified to be equal to the target temperature of the freezer compartment 4. In accordance with a further alternative, the difference between the target temperatures of the refrigerator compartment 3 and the ice maker compartment 11 are fixed and predefined, so that a target temperature of −18° C. then results for the ice maker compartment 11 for example, when the temperature difference is specified at 23° C. and a target temperature of +5° C. is set for the refrigerator compartment 3.

The thickness of the inner insulation layer 12 is significantly lower than that of the foam layer in the intermediate space 6. A surface 29 of the insulation layer 12, facing towards the refrigerator compartment 3, is therefore generally colder than the inner container 5, so that an unfavorable combination of temperature and humidity in the refrigerator compartment 3 can result in dewing on the surface 29.

In order to avoid this dewing, in the reduced-power ice making mode the target temperature of the ice maker compartment 11, despite remaining below 0° C., is specified as significantly higher than the target temperature of the normal ice making mode. It may be specified halfway between the target temperature of the normal ice making mode and 0° C., in the case observed here −9° C. If the ice maker is operated in this reduced-power mode, in addition to the temperature in the ice maker compartment 11, the temperature of the surface 29 also increases by some degrees, so that dewing on the surface 29 is avoided. The cooling output required by the ice maker is lower in this mode, but the speed of ice generation is reduced as well.

In order to control the switching between normal and reduced-power ice making mode, in accordance with one embodiment a humidity sensor 30 is provided in the refrigerator compartment 3, and a characteristic curve is stored in a memory of the regulation unit 23, which curve predefines a threshold value of the humidity as a function of the temperature of the refrigerator compartment 3. When said threshold value is exceeded, the regulation unit 23 passes from normal into reduced-power ice making mode.

In accordance with an alternative embodiment, the humidity sensor 30 is replaced by a temperature sensor 31 and a humidity sensor 32, which are both arranged on the outside of the body 2 and are exposed to the ambient air. While the humidity sensor 30 can only react when warm, humid ambient air reaches the refrigerator compartment 3, and hence condensation can still take place on the surface 29 at the start of the operation in reduced-power mode, when the ice maker compartment 11 has not yet heated to the new target temperature, the sensors 31, 32 can be used to enable an even earlier adjustment of the ice making mode, so that the tendency toward the formation of condensation is reduced further.

If the switching between normal and reduced-power ice making mode is only effected on the basis of the signals of the sensors 31, 32, the situation may occur, however, that despite switching into the reduced-power ice making mode, this is ultimately not necessary, as the door 19 remains closed and no ambient humidity reaches the refrigerator compartment 3 as a result. In such a case, the productivity of the ice maker is restricted unnecessarily. In order to avoid this, the regulation unit 23 furthermore may be connected to a switch 33 recording the opening of the door 19, and may be programmed to preserve the reduced-power ice making mode if, on the one hand, the ambient humidity exceeds a threshold value and, on the other hand, the number of door openings within a time interval with a fixed duration, which stretches from the present into the past, reaches a predefined minimum value.

In accordance with a simplified variant, the sensors 31, 32 are omitted and a decision between normal and reduced-power ice making mode is made by the regulation unit 23 alone, on the basis of the number of door openings recorded in the time interval.

In this latter case in particular, the user can be presented with the opportunity at the user interface to select between an automatic setting of the ice making mode by the regulation unit 23 and a long-term operation in the normal ice making mode. Thus, for example, the user can permanently set the normal ice making mode in a cool and dry time of year, in order to enjoy higher productivity of the ice maker, and in a warm and humid time of year he can authorize the automatic switchover, in order to prevent the formation of condensation water on the surface 29.

Information regarding the climate to which the refrigeration appliance 1 is exposed may also be obtained via the water level in the evaporation pan 28. If this is high, then a humid climate is evidently causing the need to defrost more frequently, and there is also the risk of the formation of condensation on the surface 29. Therefore, in accordance with one variant, a water level sensor 34 may also be provided on the evaporation pan 28, in order to cause the regulation unit 23 to switch into the reduced-power ice making mode, when the current water level (or possibly an average water level over a number of thawing cycles) in the evaporation pan 28 lies above a threshold value.

In accordance with another development of the invention, a sensor 38 is arranged on the storage container 17, in order to record the fill level thereof. If this is high and it therefore cannot be expected that the available ice will be depleted in a short time frame, then it is also not required to replenish the supplies rapidly. Hence, even if a threshold value of the fill level in the storage container 17 is exceeded, it is possible to switch into the reduced-power ice making mode, in order to throttle the cooling output requirement of the ice maker.

The threshold value of the fill level for switching into the reduced-power ice making mode can be close to the complete filling of the storage container 17. No later than when this is so full that the tray 15 can no longer be emptied, as its contents no longer fit into the storage container 17, the production of the ice in tray 15 should be delayed by switching into the reduced-power ice making mode.

REFERENCE CHARACTERS

1 Domestic refrigeration appliance
2 Body
3 Refrigerator compartment
4 Freezer compartment
5 Inner container
6 Outer insulation layer
7 Outer membrane
8 Dividing wall
9 Chamber
10 Evaporator
11 Ice maker compartment
12 Inner insulation layer
13 Box
14 Cover
15 Tray
16 Mold container
17 Storage container
18 Passage
19 Door
20 Dispenser alcove
21 Passage
22 Flap
23 Regulation unit

24 Temperature sensor
25 Temperature sensor
26 Temperature sensor
27 Compressor
28 Evaporation pan
29 Surface
30 Humidity sensor
31 Temperature sensor
32 Humidity sensor
33 Switch
34 Water level sensor
35 Water line
36 Valve
37 Motor
38 Sensor

The invention claimed is:

1. A domestic refrigeration appliance, comprising:
a regulator;
an inner container;
an outer insulation layer surrounding said inner container;
a refrigerator compartment being delimited by said inner container and said outer insulation layer and being regulated by said regulator to a first target temperature;
an ice maker compartment regulated by said regulator to a second target temperature;
an ice maker disposed in said ice maker compartment;
an inner insulation layer separating said ice maker compartment from said refrigerator compartment;
said inner container separating said inner insulation layer from said outer insulation layer;
said regulator being configured to switch between a normal ice making mode and a reduced-power ice making mode; and
said regulator setting said target temperature of said ice maker compartment between said target temperature of said refrigerator compartment and said target temperature of said ice maker compartment in said normal ice making mode.

2. A domestic refrigeration appliance, comprising:
a regulator;
a refrigerator compartment regulated by said regulator to a first target temperature;
an ice maker compartment regulated by said regulator to a second target temperature;
an ice maker disposed in said ice maker compartment;
an inner insulation layer separating said ice maker compartment from said refrigerator compartment;
said regulator being configured to switch between a normal ice making mode and a reduced-power ice making mode;
said regulator setting said target temperature of said ice maker compartment between said target temperature of said refrigerator compartment and said target temperature of said ice maker compartment in said normal ice making mode; and
said regulator being configured to switch from said normal ice making mode into said reduced-power ice making mode if at least one of the following conditions is fulfilled:
a) a humidity in surroundings of the domestic refrigeration appliance is above a predefined threshold value;
b) a temperature in said refrigerator compartment is above a predefined threshold value;
c) a humidity in said refrigerator compartment is above a predefined threshold value;
d) frequency of door openings of said refrigerator compartment is above a predefined threshold value; or
e) a water level in an evaporation pan is above a predefined threshold value.

3. The domestic refrigeration appliance according to claim 2, wherein said regulator is configured to be switched based on a user input between:
an automatic operating mode in which said regulator switches from said normal ice making mode into said reduced-power ice making mode when a condition occurs, and
a standard operating mode in which said normal ice making mode runs independently of a presence of said condition.

4. A domestic refrigeration appliance, comprising:
a regulator;
a refrigerator compartment regulated by said regulator to a first target temperature;
an ice maker compartment regulated by said regulator to a second target temperature;
an ice maker disposed in said ice maker compartment, said ice maker including a storage container for ice and a sensor for recording a fill level of said storage container;
an inner insulation layer separating said ice maker compartment from said refrigerator compartment;
said regulator being configured to switch between a normal ice making mode and a reduced-power ice making mode;
said regulator setting said target temperature of said ice maker compartment between said target temperature of said refrigerator compartment and said target temperature of said ice maker compartment in said normal ice making mode;
said regulator being configured to only authorize said reduced-power ice making mode when a predefined fill level of said storage container is exceeded; and
said regulator being configured to switch from said normal ice making mode into said reduced-power ice making mode if at least one of the following conditions is fulfilled:
a) a temperature in surroundings of the domestic appliance is above a predefined threshold value;
b) a humidity in surroundings of the domestic refrigeration appliance is above a predefined threshold value;
c) a temperature in said refrigerator compartment is above a predefined threshold value;
d) a humidity in said refrigerator compartment is above a predefined threshold value;
e) a frequency of door openings of said refrigerator compartment is above a predefined threshold value; or
f) a water level in an evaporation pan is above a predefined threshold value.

5. A domestic refrigeration appliance, comprising:
a regulator;
a refrigerator compartment regulated by said regulator to a first target temperature;
an ice maker compartment regulated by said regulator to a second target temperature;
an ice maker disposed in said ice maker compartment, said ice maker including a storage container for ice and a sensor for recording a fill level of said storage container;
an inner insulation layer separating said ice maker compartment from said refrigerator compartment;
said regulator being configured to switch between a normal ice making mode and a reduced-power ice making mode;

said regulator setting said target temperature of said ice maker compartment between said target temperature of said refrigerator compartment and said target temperature of said ice maker compartment in said normal ice making mode; and said regulator being configured to only authorize said reduced-power ice making mode when a predefined fill level of said storage container is exceeded.

* * * * *